US006374744B1

(12) United States Patent
Schmacker et al.

(10) Patent No.: US 6,374,744 B1
(45) Date of Patent: Apr. 23, 2002

(54) SHROUDED BOMB

(75) Inventors: Bruce E. Schmacker; Ronald L. Wooten, both of Orlando, FL (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 09/577,571

(22) Filed: May 25, 2000

(51) Int. Cl.[7] ..... F42B 12/06

(52) U.S. Cl. ..... 102/518; 102/519; 102/473; 102/489; 102/495; 102/389; 102/382

(58) Field of Search ..... 102/7.6, 489, 382, 102/293, 393, 374, 518, 473, 468; 29/1.2, 1.21, 463; 89/1.51; 244/3.24

(56) References Cited

U.S. PATENT DOCUMENTS

| | | | | |
|---|---|---|---|---|
| 3,224,334 | A | | 12/1965 | Curtis et al. |
| 3,712,219 | A | * | 1/1973 | Blair et al. |
| 4,112,843 | A | * | 9/1978 | Laviolette |
| 4,597,333 | A | | 7/1986 | Bocker et al. |
| 4,638,736 | A | * | 1/1987 | Farmer |
| 4,638,737 | A | | 1/1987 | McIngvale |
| 4,656,943 | A | | 4/1987 | Edminster |
| 4,674,407 | A | * | 6/1987 | Seubert et al. |
| 4,676,167 | A | * | 6/1987 | Huber, Jr. et al. |
| 4,911,080 | A | | 3/1990 | Leeker et al. |
| 4,920,887 | A | | 5/1990 | Frehaut et al. |
| 4,932,326 | A | | 6/1990 | Ladriere |
| 4,957,046 | A | * | 9/1990 | Puttock |
| H959 | H | | 9/1991 | Heckman et al. |
| 5,056,408 | A | | 10/1991 | Joner et al. |
| 5,103,734 | A | | 4/1992 | Arnaud et al. |
| 5,305,505 | A | * | 4/1994 | Ruhlman |
| 5,656,792 | A | * | 8/1997 | Rentzsch |
| 5,698,814 | A | * | 12/1997 | Parsons et al. |
| 5,939,662 | A | * | 8/1999 | Bootes et al. |
| 6,012,393 | A | * | 1/2000 | Tal |
| 6,123,289 | A | * | 9/2000 | Manole et al. |

FOREIGN PATENT DOCUMENTS

| | | | |
|---|---|---|---|
| CH | 667526 | A * | 10/1988 |
| CH | 670882 | A * | 7/1989 |
| DE | 3904625 | A1 * | 8/1990 |
| WO | 99/30106 | | 6/1999 |
| WO | 00/30106 | | 5/2000 |

* cited by examiner

*Primary Examiner*—Michael J. Carone
*Assistant Examiner*—Troy Chambers
(74) *Attorney, Agent, or Firm*—Burns, Doane, Swecker & Mathis, LLP

(57) ABSTRACT

A shrouded bomb is provided having components which are substantially free of weld lines and rivets. The shroud assembly includes a nose cone having a forward end and a rear end, a central tube having a forward end contiguous with the rear end of the nose cone, and a rear end, and an aft tube having a forward end contiguous with the rear end of the central tube.

21 Claims, 10 Drawing Sheets

SHROUDED BOMB

BACKGROUND OF THE INVENTION

1. Field of the Invention

The present invention is directed to projectiles. More particularly, the present invention is directed to bombs, such as aerial bombs to be dropped from aircraft.

2. State of the Art

In the discussion of the state of the art that follows, reference is made to certain structures and/or methods. However, the following references should not be construed as an admission that theses structures and/or methods constitute prior art. Applicant expressly reserves the right to demonstrate that such structures and/or methods do not qualify as prior art against the present invention.

A typical bomb configuration includes a hard casing which carries a payload material. Bombs which are designed to penetrate into the target typically include a substantially-ogive shape nose section and an elongated cylindrical body. Such bombs can be deployed by release from an aircraft.

Bombs delivered from an aircraft, including free-fall bombs, guided bombs, and boosted bombs, must pass rigorous field testing in order to demonstrate that the bombs can be safely handled and deployed, and that they can be accurately delivered to the target. Such testing must be conducted for each type of aircraft which will carry the bomb. Therefore, the development of new bomb designs is subject to significant delay and expense before the weapon is certified for use.

Efforts have been made to modify the configuration of the hard casing of such bombs in order to enhance performance characteristics. For instance, efforts have been made to modify the shape and size of the hard casing for improved penetration performance. However, modifications to the shape and size of the bomb casing affect the properties of the bomb itself such as weight, center of gravity, moment of inertia, and aerodynamic properties. As such, such modified designs would normally be subjected to the costly and time-consuming process required to certify the safety and performance of such new designs for use in the field.

In order to avoid much of the time and expense associated with re-certification or re-qualification of modified bomb configurations, the present inventors developed a shrouded bomb assembly as disclosed in WO 99/30106, the disclosure of which is incorporated herein by reference in its entirety.

The invention disclosed therein generally includes a modified bomb casing surrounded by an outer shroud member. The shroud member is configured to emulate the shape and size of an existing qualified bomb. The combination of the shroud member and the bomb casing also emulates the weight, center of gravity and moments of inertia of an existing qualified bomb. Thus, the shrouded bomb disclosed therein may be readily qualified based on similarity of function to existing qualified bombs for use on an aircraft.

A shrouded aerial bomb formed according to the principles disclosed by WO 99/30106 is illustrated in FIG. 1. The shrouded bomb SB' depicted in FIG. 1 generally includes a penetrator P' comprising a modified warhead casing C', a shroud assembly S', and an aft closure assembly AC'.

The shroud assembly S' includes forward clamp ring or H-ring segments 1', 2' and rear clamp ring or H-ring segments 3', 4' which are mounted about the outer peripheral surface of warhead casing C'. Typically, attachments lugs (not shown) are provided on the outer surface of the H-ring segments which are in turn used to attach the shrouded bomb SB' to an aircraft. The shroud assembly S' further includes a central shell or tube 5', a nose cone 6', a nose collar 11' and an aft shell or tube 12'. Thus, as clearly illustrated in FIG. 1, the shroud assembly S' comprises numerous individual parts which must be assembled about the warhead casing C'. Such assembly is tedious and time-consuming and, thus. Thus can increase the costs associated with production of the shrouded bomb SB'.

Each individual component of the shroud assembly S' is fabricated from sheet material. Thus, fabrication of each individual component requires riveting and welding steps which further adds to the costs and complexity of manufacture of the shrouded bomb SB'.

Moreover, accurate fabrication and assembly of the components of the shroud assembly S' is dependent upon the skill of the worker fabricating and assembling the shrouded bomb SB'. As such, it can be difficult to consistently achieve quality in the fabrication and assembly of the shroud assembly S' and the shrouded bomb SB'.

SUMMARY OF THE INVENTION

The present invention satisfies the abovementioned needs, and others, by providing an improved shroud assembly.

More particularly, the present invention provides an improved shrouded bomb which is fabricated and assembled at reduced costs, and less time, and with greater quality than previous shrouded bombs.

In one aspect, the present invention provides a shrouded bomb comprising a penetrating body surrounded by an outer shroud member, the shroud comprising a nose cone having a forward end and a rear end, a central tube having a forward end contiguous with the rear end of the nose cone, and a rear end, and an aft tube having a forward end contiguous with the rear end of the central tube.

In a second aspect, the present invention provides a shroud comprising a nose cone having a forward end and a rear end, a central tube having a forward end contiguous with the rear end of the nose cone, and a rear end, and an aft tube having a forward end contiguous with the rear end of the central tube.

BRIEF DESCRIPTION OF THE DRAWING FIGURES

Other objects and advantages of the present invention will become more apparent to those skilled in the art from reading the following detailed description of preferred embodiments in conjunction with the accompanying drawings, wherein like elements have been designated with like reference numerals, and wherein.

DETAILED DESCRIPTION OF THE PREFERRED EMBODIMENTS

A shrouded bomb SB formed consistent with the principles of the present invention will now be described with reference to FIGS. 2–13.

Figure 1:
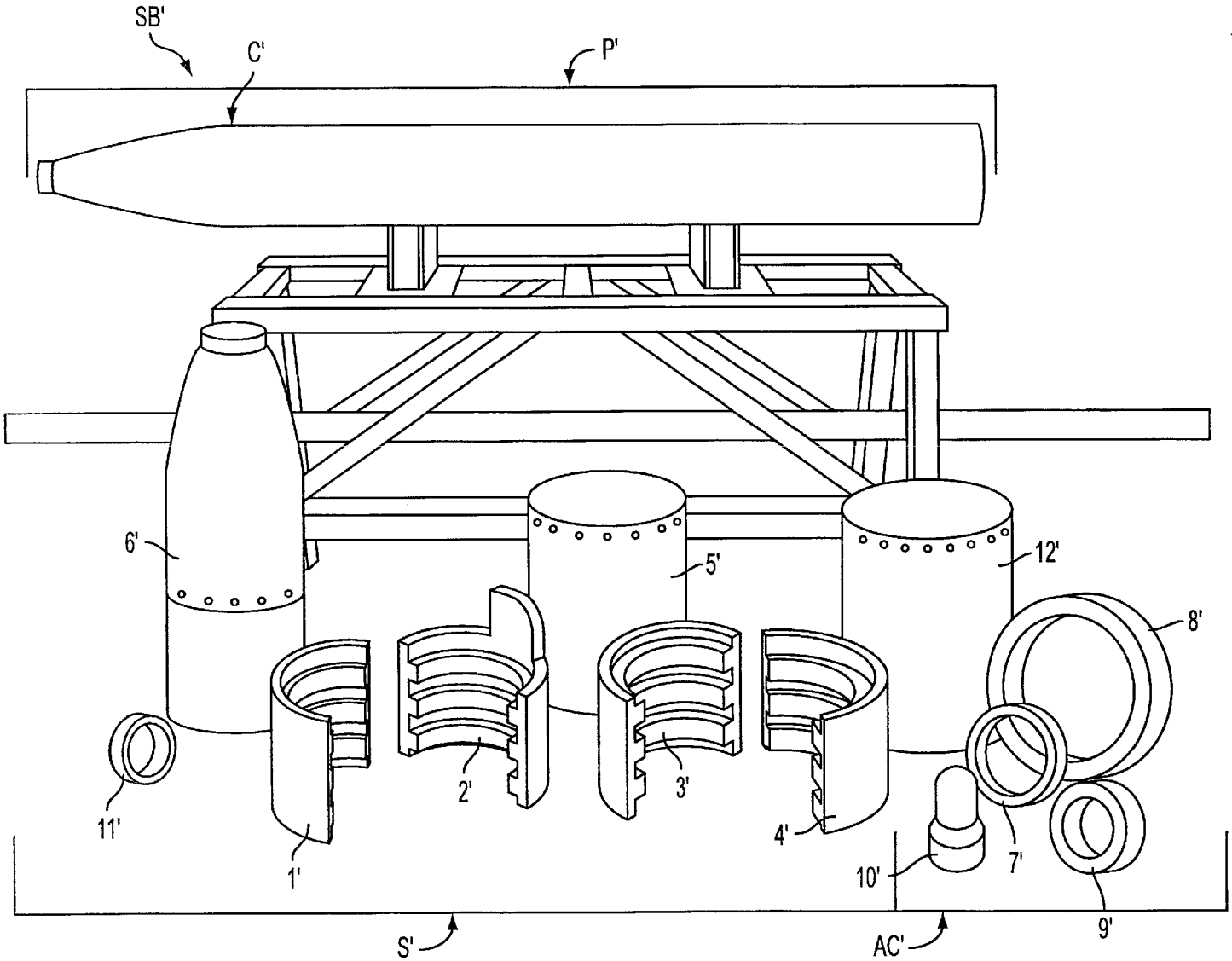
FIG. 1 PRIOR ART
FIG. 1 is a perspective view of a disassembled shrouded bomb according to a previous construction.
Figure 2:
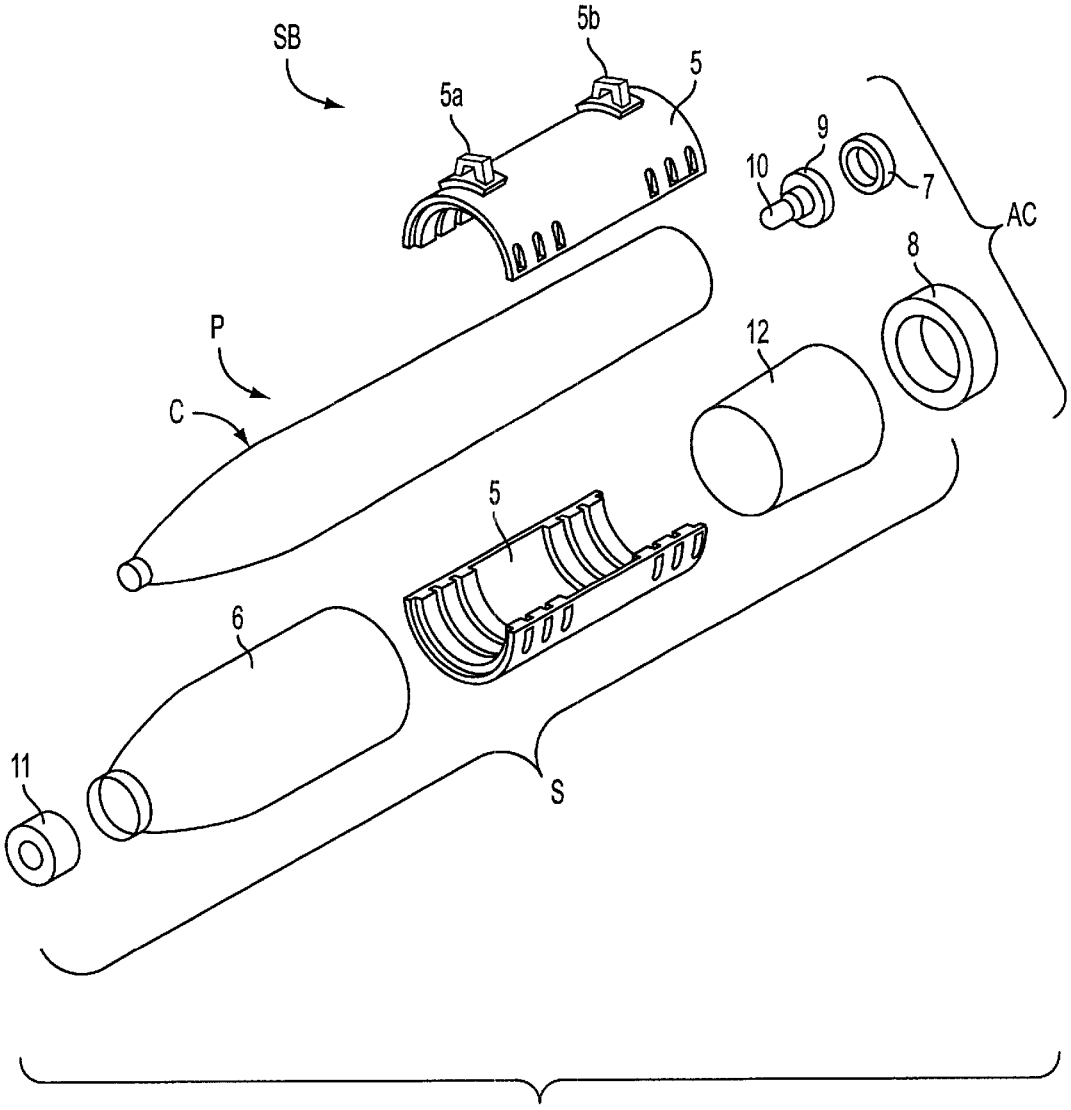
FIG. 2 is an exploded view of a shrouded bomb formed according to the principles of the present invention.
Figure 3:
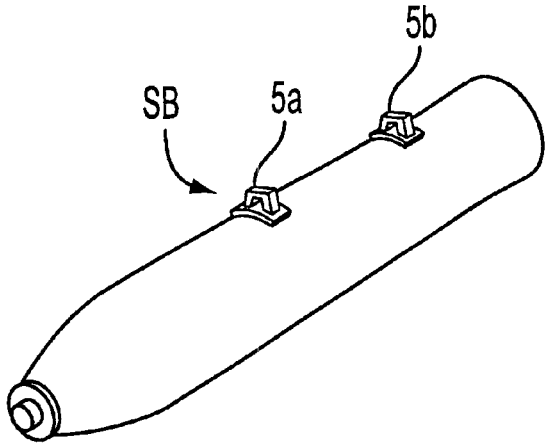
FIG. 3 is a perspective view of the shrouded bomb of FIG. 2, but in an assembled condition.
Figure 4:
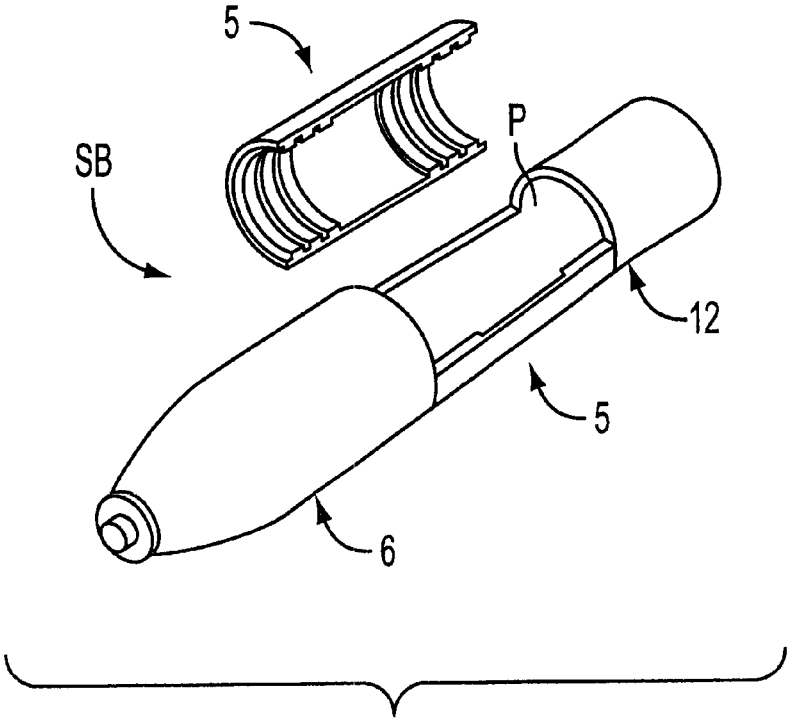
FIG. 4 is a perspective view of the shrouded bomb of FIG. 3, but with a section of the central tube removed to reveal the penetrator.

As illustrated, for example, in FIGS. 2–4, the shroud assembly S is far simpler in construction, and utilizes fewer component parts when compared to the previous shroud assembly S' depicted in FIG. 1. As illustrated in FIGS. 2–4, a shrouded bomb SB formed according to the present invention generally includes a penetrator P comprising a warhead casing C, a shroud assembly S, and an aft closure assembly AC. The particular warhead casing C construction is not essential to the present invention. However, for purposes of illustration, warhead casing C can be of the kind disclosed in WO 99/30106. Typically, such warhead casings include a hollow interior which is capable of carrying a payload material. The casing C is usually made from a hardened material which further adds to its target penetrating capabilities.

The shroud assembly S includes a central shell or tube 5. Typically, attachment lugs 5*a* and 5*b* are attached to an outer surface of the central tube as illustrated in FIGS. 2 and 3.

The shroud assembly S further comprises a nose cone 6, nose collar 11 and an aft shell or tube 12.

As illustrated in FIG. 2, the shrouded bomb SB further includes an aft closure assembly AC. Aft closure assembly AC includes an aft closure ring 7, tail or bulkhead ring 8 and integrated fuse liner collar 9 and fuse liner 10. Once assembled, the aft closure assembly seals the aft closure of both the penetrator P and shroud assembly S.

Aft closure assembly AC represents an improvement over the conventional aft closure assembly AC'. For instance, the fuse liner collar 9 and fuse liner 10 of the aft closure assembly AC have been integrated, preferably provided as a one-piece member, which provides a better seal within the aft closure and is generally more effective in preventing the leakage of payload materials from inside the shrouded bomb SB.

As illustrated in FIGS. 3 and 4, once assembled, the shrouded bomb SB of the present invention emulates the appearance, dimensions, and mass properties of an existing, previously qualified or certified bomb. As previously noted, the penetrator P can be modified to attain different performance characteristics from the penetrator of an existing certified bomb. For instance, the penetrator may be reconfigured to improve its penetration capabilities.

Upon impact with the target, the shroud assembly S is stripped away and the casing C penetrates into the target.

Various components of the shroud assembly S will now be described in further detail through reference to FIGS. 5–13.

Figure 5:
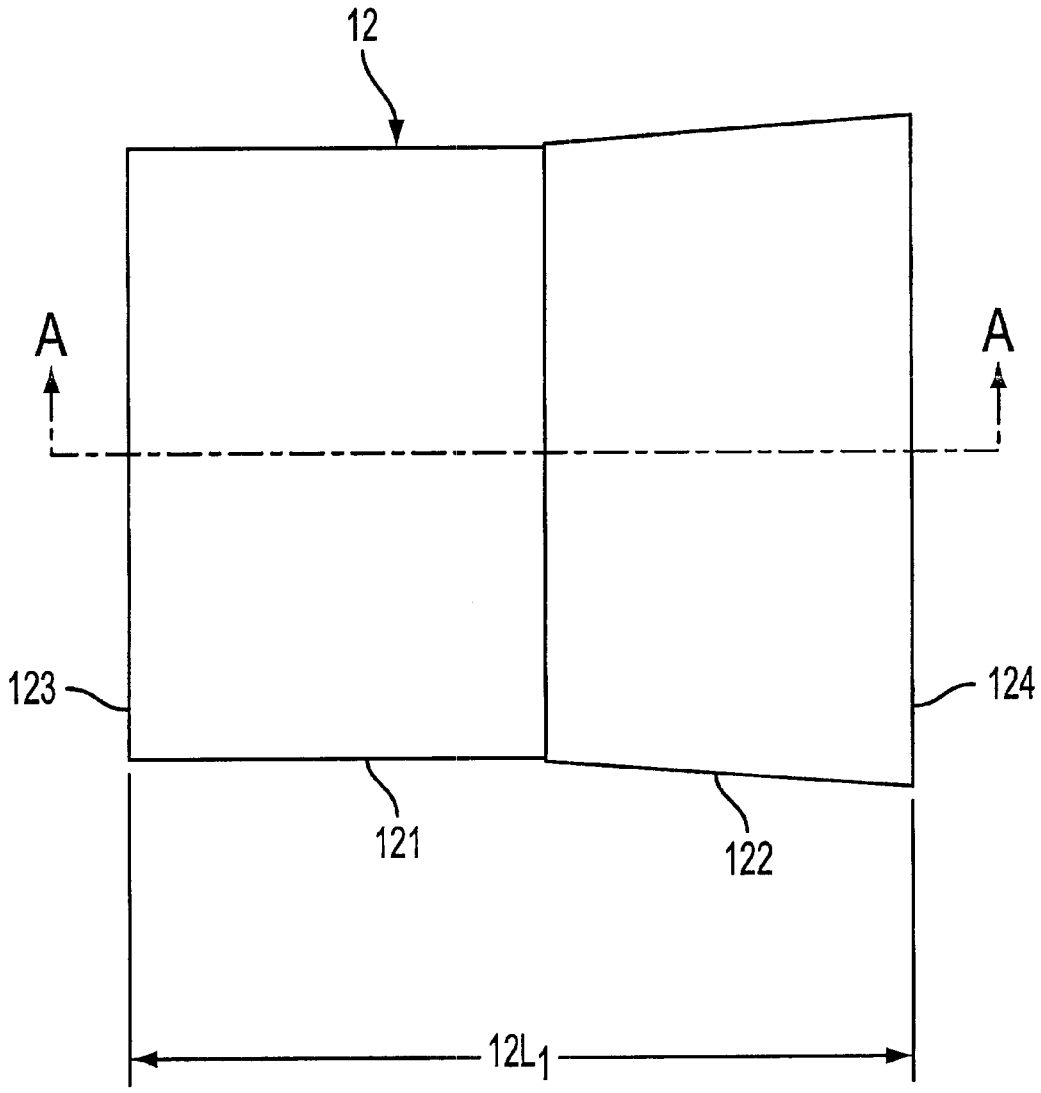
FIG. 5 is a side plan view of an aft tube formed according to the principles of the present invention.
Figure 6:
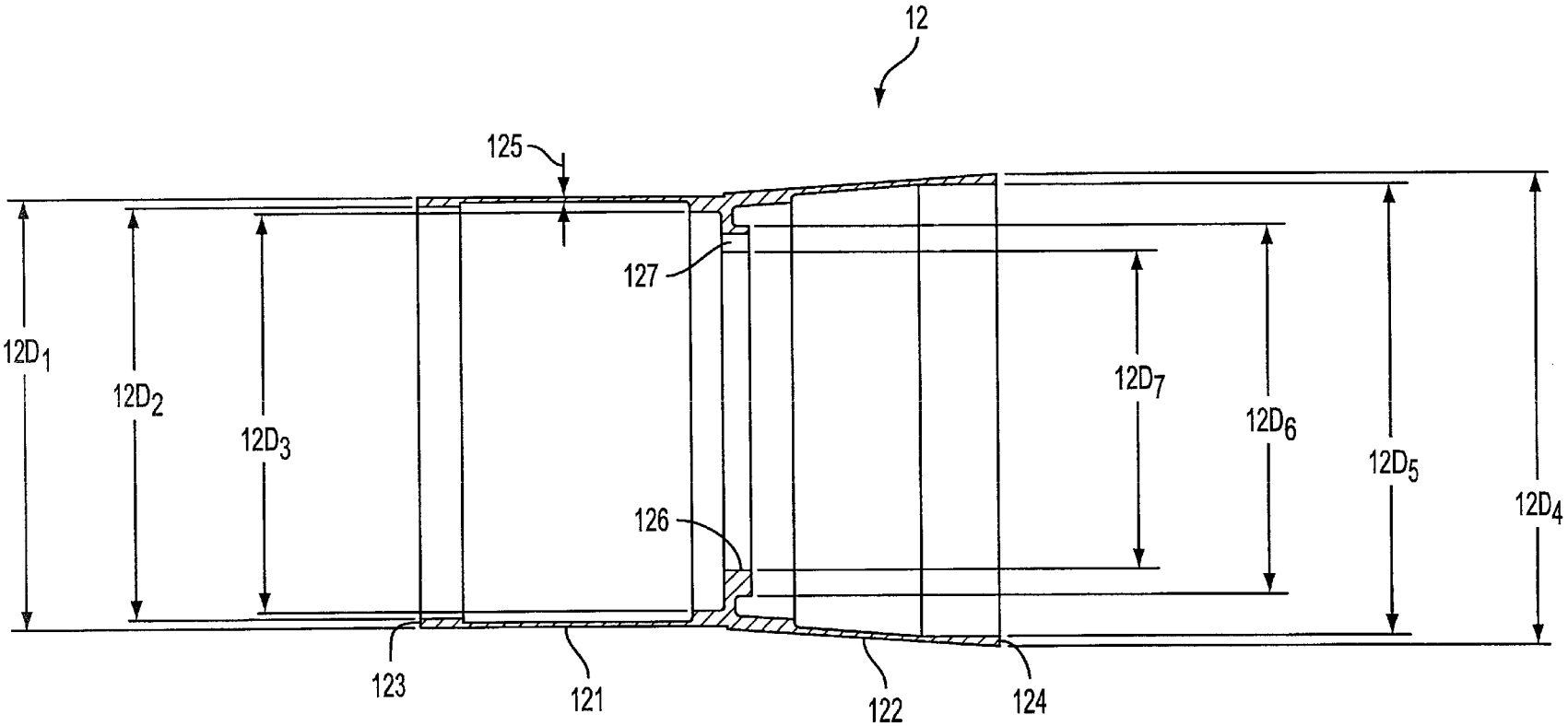
FIG. 6 is a cross-sectional view taken along line A—A of FIG. 5.

As illustrated in FIGS. 5 and 6, the aft tube 12, and preferred embodiments generally comprises a first cylindrical section 121 and a second flared section 122. The aft tube 12 preferably lacks the weld lines and rivets associated with the prior construction. Preferably, the aft tube 12 is formed by casting and machining. Aft tube 12 further includes a first forward end 123 and a rear end 124. Aft tube 12 can be formed of any suitable material, such as an aluminum alloy. Preferably, the aft tube 12 generally comprises a thin-walled tubular construction. A projection or shelf 126 having a groove 127 may be formed along the interior of the aft tube 12. The casing C interfaces with the projection 126. Groove 127 is designed to accommodate a power cable (not shown). As previously noted, the particular shape and dimensions of the aft tube 12 can vary, depending primarily upon the particular qualified bomb configuration being emulated. For purposes of illustration, the aft tube 12 can be provided with the following dimensions.

| ELEMENT | DESCRIPTION | DIMENSION (inches) |
|---|---|---|
| 125 | wall thickness | 0.19 |
| $12D_1$ | outer diameter at forward end 123 | 14.56 |
| $12D_2$ | inner diameter at forward end 123 | 13.94 |
| $12D_3$ | inner diameter of step of projection 126 | 13.56 |
| $12D_4$ | outer diameter at rear end 124 | 16.02 |
| $12D_5$ | inner diameter at rear end 124 | 15.28 |
| $12D_6$ | outer diameter at projection 126 | 12.50 |
| $12D_7$ | inner diameter of projection 126 | 10.80 |

It should be noted that the above-described dimensions are approximate and can be varied, depending upon the particular application. Moreover, the above-noted dimensions can be varied within acceptable engineering tolerances.

Figure 7:
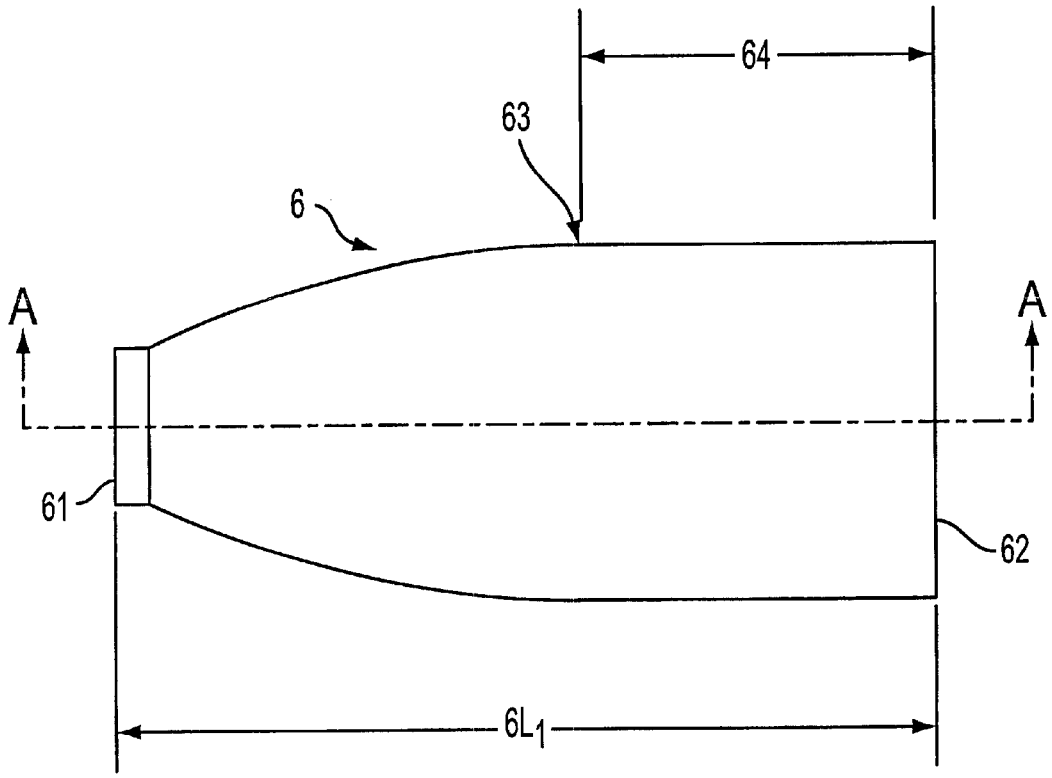
FIG. 7 is a side plan view of a nose cone formed according to the principles of the present invention.
Figure 8:
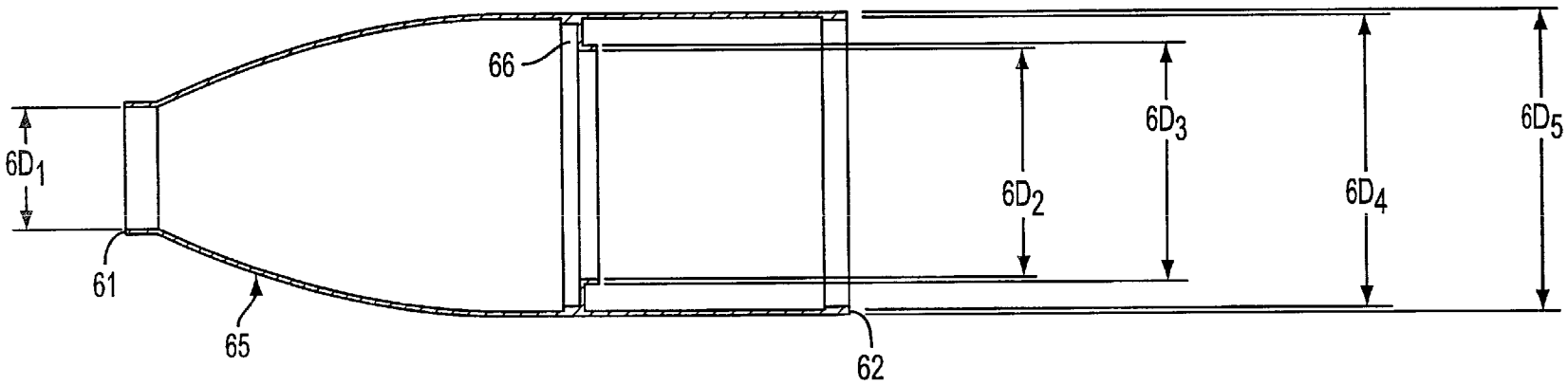
FIG. 8 is a cross-sectional view taken along line A—A of FIG. 7.
Figure 9:
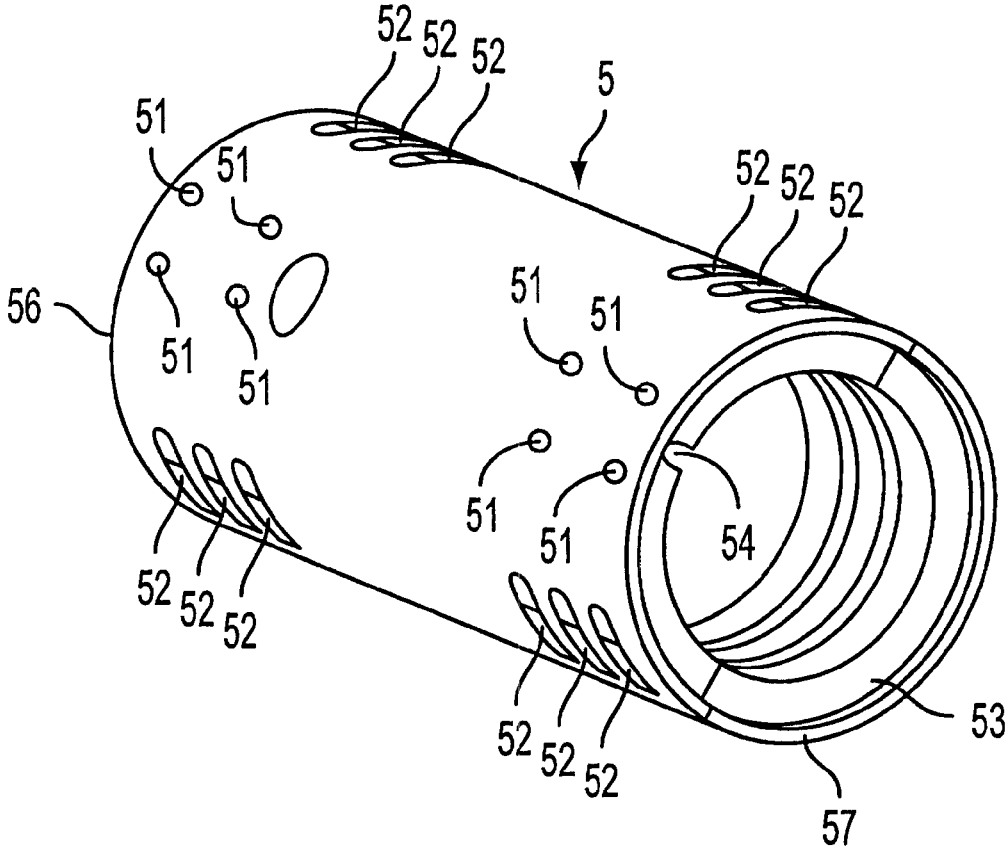
FIG. 9 is a perspective view of a central tube formed according to the principles of the present invention.
Figure 10:
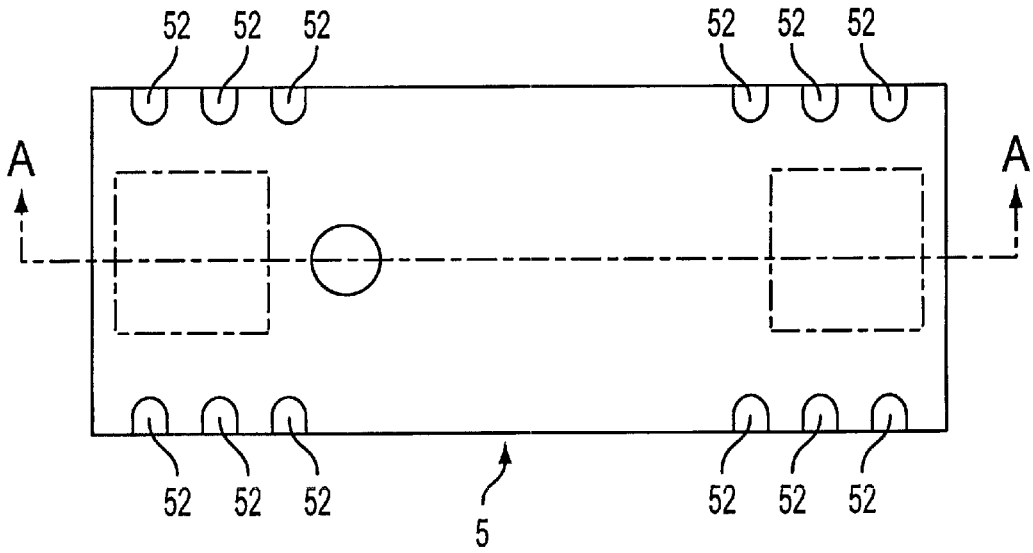
FIG. 10 is a top plan view of the central tube of FIG. 9.
Figure 11:
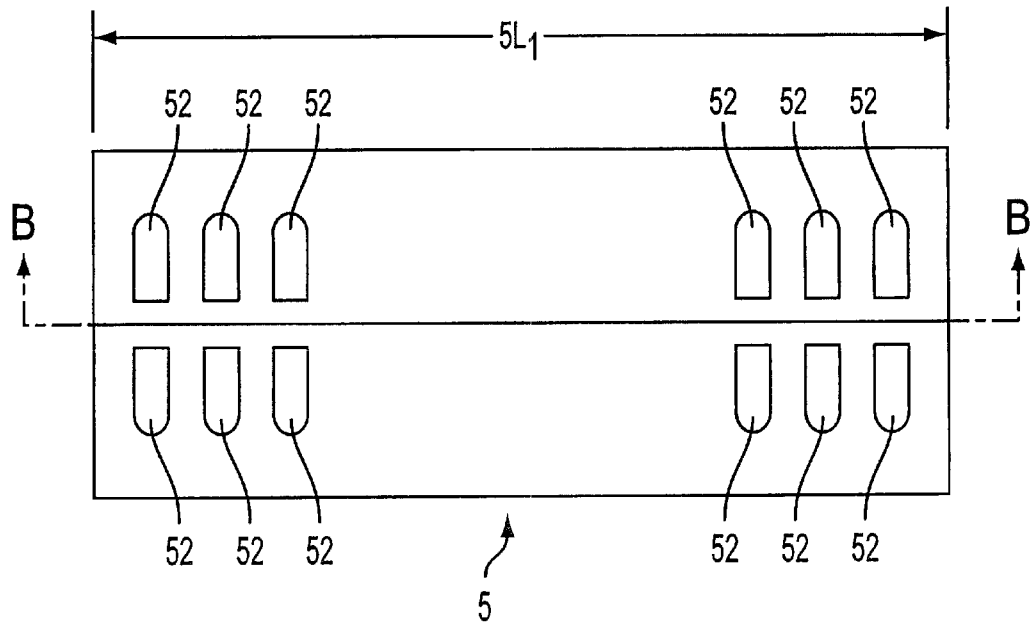
FIG. 11 is a side plan view of the central tube of FIG. 9.

As illustrated in FIGS. 7 and 8, the nose cone 6 is also preferably free of any weld lines or rivets. Thus, one preferred technique for forming the nose cone 6 is casting and subsequent machining of a suitable material, such as aluminum alloy. The nose cone 6 generally comprises a forward end 61 to which a nose collar 11 may be mounted, and a rear end 62. A tangent point 63 delineates the beginning of a substantially ogive-shaped surface that extends toward the forward end 61 of the nose cone 6. The portion of the nose cone 6 extending from tangent point 63 toward the rear end surface 62, and preferred embodiments, is substantially cylindrical. The nose cone 6 is also preferably formed as a thin-walled hollow component. Nose cone 6 may further be provided with an interior projection 66. The projection 66 interfaces with the casing C.

The particular shape and dimensions of nose cone 6 can vary depending primarily upon the configuration of the existing pre-certified bomb which is to be emulated. For purposes of illustration only, nose cone 6 may have the following dimensions and characteristics.

| ELEMENT | DESCRIPTION | DIMENSION (inches) |
|---|---|---|
| 64 | longitudinal distance between tangent point 63 and rear end 62 | 15.25 |
| 65 | radius of curvature of substantially ogive-shaped surface | 43.50 |
| $6D_1$ | inner diameter at first end 61 | 5.80 |
| $6D_2$ | inner diameter of projection 66 | 10.90 |
| $6D_3$ | outer diameter at projection 66 | 11.40 |
| $6D_4$ | inner diameter at rear end 62 | 13.94 |

-continued

| ELEMENT | DESCRIPTION | DIMENSION (inches) |
|---|---|---|
| $6D_5$ | outer diameter at rear end 62 | 14.56 |
| $6L_1$ | longitudinal length between forward end 61 and rear end 62 | 35.40 |

It should be noted that the above-listed dimensions are approximate. These dimensions can be varied, depending upon the application. Moreover, the above-noted dimensions can be varied within acceptable engineering tolerances.

A preferred embodiment of a central tube 5 is illustrated in FIGS. 9–13. Central tube 5 also preferably lacks weld lines and rivets. As such, the central tube 5 can be formed by an appropriate technique, such as casting and subsequent machining, or can be formed as a forged tube which may provide improved strength and improved performance when subjected to more severe loads. Central tube 5 can be formed from any suitable material, such as an aluminum alloy.

Figure 12:
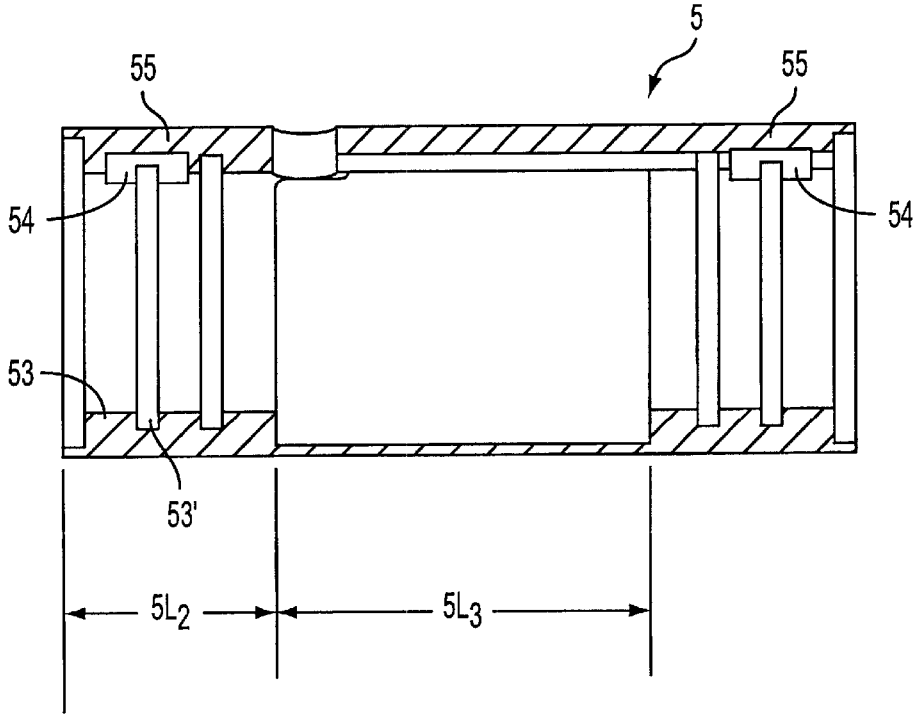
FIG. 12 is a cross-sectional view taken along line A—A of FIG. 10.
Figure 13:
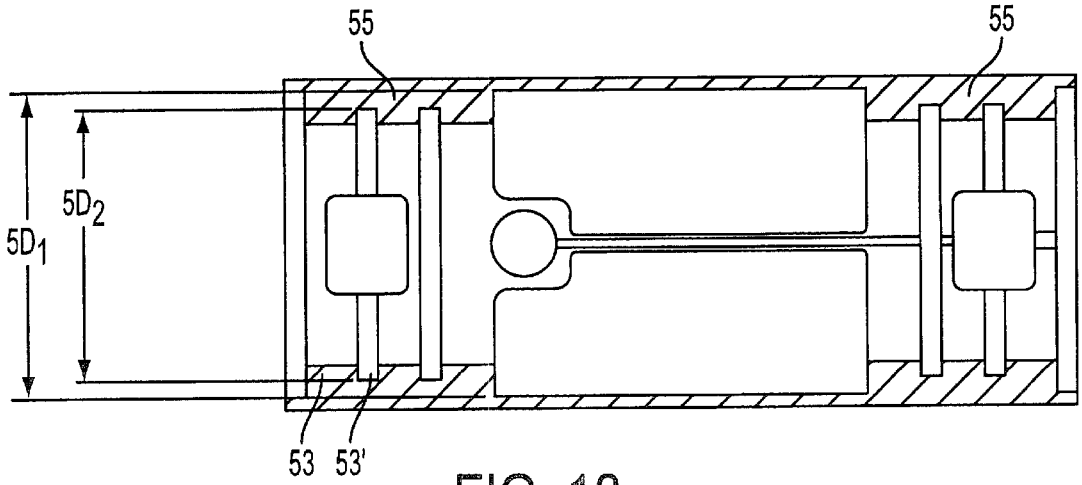
FIG. 13 is a cross-sectional view taken along line B—B of FIG. 11.

The central tube 5 may be provided with a plurality of holes 51 through which lugs (5*a*, 5*b*, FIG. 3) may be attached to the outer periphery of the central tube 5. As illustrated in FIG. 4, the central tube 5 can be segmented, thereby forming cooperating semi-circular sections which are attached to each other. When central tube 5 is sectioned in this manner, the cooperating sections are attached together, preferably by fasteners such as bolts. Therefore, bolt access apertures 52 may be further provided in the outer periphery of the central tube 5. Central tube 5 is also provided with a forward end 56 and a rear end 57. As illustrated, for example, in FIGS. 12 and 13, the cross-section of the central tube 5 is somewhat different than that of the previously-described components. This is principally due to the fact that the central tube 5 must be reinforced and substantially stronger than the other components of the shroud assembly S. Increased strength of the central tube 5 is necessitated by the fact that the loads applied and transmitted from the shroud assembly S to and from the penetrator P is done via the central tube 5. Thus, the shrouded bomb SB can safely and dependably be attached to an aircraft via lugs 5*a* and 5*b* which are attached to the central tube 5. Moreover, the shrouded bomb SB can be handled by applying a lifting device or platform at the location of the reinforced central tube 5, since the relatively thin-sectioned nose cone 6 and aft tube 12 are not capable of supporting these loads by themselves. Thus, as illustrated in FIGS. 12 and 13, the central tube may be provided with a generally thicker sectional configuration, and may be further provided with spaced reinforced sections 55 having projecting ribs 53 and corresponding grooves 53' formed therein. The projecting ribs may be further provided with one or more grooves 54. The grooves 54 are designed to accommodate lug support members (not shown).

The particular shape and dimensions of the central tube 5 can vary, primarily based upon the configuration of the pre-certified bomb which is to be emulated.

| ELEMENT | DESCRIPTION | DIMENSION |
|---|---|---|
| $5L_1$ | longitudinal distance between forward end 56 and rear end 57 | 38.00 |

-continued

| ELEMENT | DESCRIPTION | DIMENSION |
|---|---|---|
| $5L_2$ | longitudinal distance between end of center tube 5 and end of reinforcing section 55 | 10.06 |
| $5L_3$ | longitudinal separation distance between ends of reinforcing sections 55 | 17.88 |
| $5D_1$ | inner diameter at end of central tube 5 | 13.44 |
| $5D_2$ | outer diameter of groove 53' | 12.00 |

It should be noted that the above-listed dimensions are approximate. These dimensions can be varied, depending upon the application. Moreover, the above-noted dimensions can be varied within acceptable engineering tolerances.

As illustrated, for example, in FIGS. 3 and 4, the above-described components are assembled contiguous with each other thereby surrounding the penetrator P and providing an outer structure which emulates a pre-certified bomb. The word "contiguous" as used here is intended to mean that the components are immediately adjacent to each other without intervening components. Thus, the above-described components could be in direct contact with each other. However, it is also contemplated that the above-described components could be incidentally separated by such items as sealants, adhesives, fasteners, gaskets, etc.

Once assembled, the nose collar 11, if provided, is fitted within the forward end 61 of the nose cone 6 and preferably extends over a nose portion of the penetrator P. The rear end 62 of the nose cone 6 is contiguous with the forward end 56 of the central tube 5. The rear end 57 of the central tube 5 is, in turn, contiguous with the forward end 123 of the aft tube 12.

The assembled components are attached to one another by any suitable means, such as riveting.

Through the above-described construction, the shrouded bomb SB of the present invention provides for an overall reduction in the number of separate components to be assembled, reduces the amount of time necessary for fabrication and assembly of the shroud, reduces the costs associated with fabrication and assembly of the shroud, improves the ability to mass produce a shrouded bomb of higher quality with greater consistency, and provides an aft closure which more reliably seals against escape of the payload material contained within penetrator P.

Although the present invention has been described by reference to particular embodiments, it is in no way limited thereby. To the contrary, modifications and variants will be apparent to those skilled in the art in the context of the following claims.

We claim:

1. A shrouded bomb comprising a penetrating body surrounded by an outer shroud member, the shroud comprising:

a nose cone having a forward end and a rear end;

a nose collar mounted within the forward end of the nose cone, and about an end portion of the penetrating body;

a central tube having a forward end contiguous with the rear end of the nose cone, and a rear end; and an aft tube having a forward end contiguous with the rear end of the central tube.

2. The shrouded bomb of claim 1, wherein the nose cone, central tube, and aft tube are cast structures and are substantially free of any rivets or welds.

3. The shrouded bomb of claim 1, wherein the nose cone, central tube, and aft tube are made from an aluminum alloy.

4. The shrouded bomb of claim 1, wherein the nose cone comprises a substantially ogive-shaped outer surface.

5. The shrouded bomb of claim 1, wherein the central tube comprises a forged tube and is substantially free of and welds or rivets.

6. The shrouded bomb of claim 1, wherein the central tube comprises at least two segments.

7. The shrouded bomb of claim 1, wherein the central tube comprises two semicircular segments.

8. A shrouded bomb comprising a penetrating body surrounded by an outer shroud member, the shroud comprising:

a nose cone having a forward end and a rear end;

a central tube having a forward end contiguous with the rear end of the nose cone, and a rear end; and an aft tube having a forward end contiguous with the rear end of the central tube;

wherein the aft tube comprises a first cylindrical section and a second flared section.

9. The shrouded bomb of claim 1, wherein the central tube possesses greater strength that the nose cone or the aft tube.

10. The shrouded bomb of claim 1, wherein the central tube comprises a thicker sectional configuration relative to the nose cone and the aft tube, and comprises spaced reinforced sections.

11. A shroud comprising:

a nose cone having a forward end and a rear end;

a central tube having a forward end contiguous with the rear end of the nose cone, and a rear end, the central tube comprises at least two segments; and an aft tube having a forward end contiguous with the rear end of the central tube.

12. The shroud of claim 11, wherein the nose cone, central tube, and aft tube are cast structures and are substantially free of any rivets or welds.

13. The shroud of claim 11, wherein the nose cone, central tube, and aft tube are made from an aluminum alloy.

14. The shroud of claim 11, wherein the nose cone comprises a substantially ogive-shaped outer surface.

15. The shroud of claim 1, wherein the central tube comprises a forged tube and is substantially free of and welds or rivets.

16. The shroud of claim 11, wherein the central tube comprises two semicircular segments.

17. The shroud of claim 11, wherein the central tube possesses greater strength that the nose cone or the aft tube.

18. The shroud of claim 11, wherein the central tube comprises a thicker sectional configuration relative to the nose cone and the aft tube, and comprises spaced reinforced sections.

19. A shrouded bomb comprising a penetrating body surrounded by an outer shroud member, the shroud comprising:

a nose cone having a forward end and a rear end;

a central tube having a forward end contiguous with the rear end of the nose cone, and a rear end, the central tube comprises two longitudinally spaced reinforcing sections;

an aft tube having a forward end contiguous with the rear end of the central tube; and attachment lugs attached to an outer surface of the central tube.

20. A shrouded bomb comprising a penetrating body surrounded by an outer shroud member, the shroud comprising:

a nose cone having a forward end and a rear end;

a central tube having a forward end contiguous with the rear end of the nose cone, and a rear end;

an aft tube having a forward end contiguous with the rear end of the central tube; and an aft closure assembly, the aft closure assembly comprising a bulkhead ring, an aft closure ring and an integral fuze liner and fuze liner collar.

21. A shroud comprising:

a nose cone having a forward end and a rear end;

a central tube having a forward end contiguous with the rear end of the nose cone, and a rear end; and an aft tube having a forward end contiguous with the rear end of the central tube;

wherein the aft tube comprises a first cylindrical section and a second flared section.

* * * * *

UNITED STATES PATENT AND TRADEMARK OFFICE

CERTIFICATE OF CORRECTION

PATENT NO. : 6,374,744 B1
DATED : April 23, 2002
INVENTOR(S) : Bruce E. Schmacker It is certified that error appears in the above-identified patent and that said Letters Patent is hereby corrected as shown below:

Column 7,
Line 4, “and” (second occurrence) has been changed to -- any --.
Line 40, “claim 1” has been changed to -- claim 11 --.
Line 41, “and” (second occurrence) has been changed to -- any --.

Signed and Sealed this

Twenty-ninth Day of October, 2002

*Attest:*

*Attesting Officer*

JAMES E. ROGAN
*Director of the United States Patent and Trademark Office*